US007168981B2

(12) United States Patent
Takahashi

(10) Patent No.: US 7,168,981 B2
(45) Date of Patent: Jan. 30, 2007

(54) CONNECTOR

(75) Inventor: Toshiharu Takahashi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/311,327

(22) Filed: Dec. 20, 2005

(65) Prior Publication Data

US 2006/0160420 A1 Jul. 20, 2006

(30) Foreign Application Priority Data

Jan. 14, 2005 (JP) ..... 2005-007666

(51) Int. Cl.
*H01R 13/40* (2006.01)

(52) U.S. Cl. ..... 439/595

(58) Field of Classification Search ..... 439/595, 439/883

See application file for complete search history.

(56) References Cited

U.S. PATENT DOCUMENTS

| | | | | |
|---|---|---|---|---|
| 6,685,506 | B1 * | 2/2004 | Nakamura et al. | 439/595 |
| 6,786,756 | B2 * | 9/2004 | Mase et al. | 439/358 |
| 6,786,768 | B2 * | 9/2004 | Murakami | 439/595 |
| 2001/0027058 | A1 * | 10/2001 | Pederson et al. | 439/595 |
| 2002/0168895 | A1 * | 11/2002 | Suzuki | 439/595 |
| 2002/0168896 | A1 * | 11/2002 | Suzuki | 439/595 |
| 2004/0023555 | A1 * | 2/2004 | Nakamura et al. | 439/595 |
| 2004/0038589 | A1 * | 2/2004 | Takahashi et al. | 439/595 |
| 2004/0067686 | A1 * | 4/2004 | Nimura | 439/595 |
| 2004/0087209 | A1 * | 5/2004 | Nakamura | 439/595 |
| 2004/0180576 | A1 * | 9/2004 | Hasebe | 439/595 |
| 2004/0192108 | A1 * | 9/2004 | Ward et al. | 439/595 |
| 2004/0203287 | A1 * | 10/2004 | Itou et al. | 439/595 |
| 2005/0085126 | A1 * | 4/2005 | Sagawa et al. | 439/595 |
| 2005/0085127 | A1 * | 4/2005 | Meada | 439/595 |
| 2005/0090148 | A1 * | 4/2005 | Sagawa et al. | 439/595 |
| 2005/0112943 | A1 * | 5/2005 | Sagawa et al. | 439/595 |
| 2005/0124216 | A1 * | 6/2005 | Sagawa et al. | 439/595 |
| 2005/0186842 | A1 * | 8/2005 | Fukatsu et al. | 439/595 |
| 2005/0250385 | A1 * | 11/2005 | Tsuji | 439/595 |
| 2006/0003631 | A1 * | 1/2006 | Fukatsu et al. | 439/595 |

FOREIGN PATENT DOCUMENTS

| | | | |
|---|---|---|---|
| GB | 2 376 355 | A | 12/2002 |
| JP | 3-55674 | U | 5/1991 |
| JP | 8-250215 | A | 9/1996 |
| JP | 2001-110500 | A | 4/2001 |

OTHER PUBLICATIONS

Search Report dated Apr. 11, 2006.
Combined Search and Examination Report dated Apr. 12, 2006.

* cited by examiner

*Primary Examiner*—Ross Gushi
(74) *Attorney, Agent, or Firm*—Sughrue Mion, PLLC

(57) ABSTRACT

A connector comprising: a connection terminal; a connector housing having a terminal receiving chamber in which said connection terminal is inserted and a lance that is elastically deformable to engage the connection terminal in the connector housing; and a front holder supported on a front end portion of said terminal receiving chamber so as to be movable along said inserting direction; wherein said front holder is pressed by a mating connector to be moved in the opposite direction in accordance with a fitting movement of said connector relative to said mating connector; and when said connector is completely fitted relative to said mating connector, said front holder abuts against said connection terminal, and cooperates with said lance to hold said connection terminal therebetween.

4 Claims, 13 Drawing Sheets

CONNECTOR

BACKGROUND OF THE INVENTION

1. Field of the Invention

This invention relates to a connector.

2. Related Art

In a connector of an ordinary structure as shown in FIG. 14, a female terminal 3 is inserted into a terminal receiving chamber 2, formed in a female connector housing 1, to be received therein, and is retained by a lance 4 against withdrawal. Similarly, a male terminal 6 is inserted into a terminal receiving chamber 2', formed in a male connector housing 5, to be received therein, and is retained by a lance 4' against withdrawal. When the female and male connector housings 1 and 5 are fitted together, the corresponding female and male terminals 3 and 6 are connected together (see, for example, JP-U-03-055674).

Detailed description will be made of the structure of holding the terminal in the terminal receiving chamber against withdrawal. With respect, for example, to the female connector housing 1 shown in FIG. 14, the lance 4 has a projection 7 formed on its upper surface as shown in FIG. 15, and this lance 4 is formed integrally on a bottom surface of the terminal receiving chamber 2 in a cantilever manner so as to be elastically deformed. The female terminal 3, while elastically deforming the lance 4, is inserted into the terminal receiving chamber 2 from a rear end (right side in FIG. 15), and when the female terminal 3 is inserted into a predetermined position, the lance 4 is restored from its elastically-deformed condition, so that the projection 7 is fitted into an opening 8 formed in a bottom surface of the female terminal, thereby holding the female terminal 3 in the terminal receiving chamber 2 against withdrawal. The male connector housing 5 has a similar structure.

In the above withdrawal prevention mechanism depending on the cantilever-like lance 4, however, the lance 4 is generally pivotally moved about its proximal end portion, and therefore a certain degree of clearance must be provided between the projection 7 of the lance 4 and a retaining edge 8*a* of the opening 8. Therefore, for example, when vibration is applied to the connector, the female terminal 3 shakes or slightly moves back and forth within the terminal receiving chamber 2, and a relative slight sliding movement repeatedly occurs between contact portions of the female and male terminals 3 and 6, and therefore there is a fear that the contact portions are gradually worn, so that a pressure of contact between the contact portions decreases, thus adversely affecting the electrical connection between the female and male terminals.

Therefore, there is known a connector designed to suppress the shaking of a connection terminal within a terminal receiving chamber (see, for example, JP-A-2001-110500). FIG. 16 is a vertical cross-sectional view of the conventional connector 10 disclosed in JP-A-2001-110500. As shown in FIG. 16, the connector 10 comprises a female terminal 12, and a female connector housing 11, and this female connector housing 11 includes a terminal receiving chamber 13 into which the female terminal 12 is inserted from a rear end thereof (right side in FIG. 16), and a lance 14 for retaining the female terminal 12, received in the terminal receiving chamber 13, against withdrawal. A front holder 15 is attached to a front end portion of the terminal receiving chamber 13. A projection 16 of the lance 14 is fitted on a retaining edge 19*a* of an opening 19 in the female terminal 12, thereby retaining the female terminal 12 against withdrawal. Further, a front abutment portion 17 of the front holder 15 is brought into abutting engagement with a front end of the female terminal 12, thereby pushing the female terminal 12 toward the projection 16 of the lance 14, so that the female terminal 12 is held between the projection 16 of the lance 14 and the front abutment portion 17 of the front holder 15. Thus, the female terminal 12 is prevented from slightly moving back and forth within the terminal receiving chamber 13.

In the connector 10 disclosed in Patent Literature 2, the shaking of the female terminal 12 within the terminal receiving chamber 13 is prevented by the lance 14 and the front holder 15, and the decrease of a contact pressure due to wear of contact portions can be prevented. However, when the front holder 15 is attached to the terminal receiving chamber 13, the female terminal 12 is completely fixed in position within the terminal receiving chamber 13, and therefore during the time when a mating connector (not shown) is fitted to the connector 10, the female terminal 12 can not move, following a male terminal 18, and besides free resilient deformation of the female terminal is prevented. Therefore, a force, required for inserting the male terminal 18 of the mating connector (that is, a resistance to the insertion of the connection terminal), increases, and it is difficult to fit the connector 10 to the mating connector. Furthermore, when forcibly fitting the connector 10 to the mating connector, there has been a fear that the female and male terminals 12 and 18 are deformed.

This invention has been made in view of the above problems, and an object of the invention is to provide a connector in which the shaking of a connection terminal can be prevented without increasing a resistance to the insertion of the connection terminal, and even when vibration is applied to the connector, the reliability of electrical connection of the connection terminal can be maintained.

SUMMARY OF THE INVENTION

The above object has been achieved by a connector of the present invention having features recited in the following Paragraphs (1) to (4).

(1) A connector comprising:

a connection terminal;

a connector housing having a terminal receiving chamber in which the connection terminal is inserted and a lance that is elastically deformable to engage the connection terminal in the connector housing; and a front holder supported on a front end portion of the terminal receiving chamber so as to be movable along an inserting direction of the connector relative to a mating connector;

wherein the front holder is pressed by said mating connector to be moved in an opposite direction to the insertion direction in accordance with a fitting movement of the connector relative to the mating connector; and when the connector is completely fitted relative to the mating connector, the front holder abuts against the connection terminal, and cooperates with the lance to hold the connection terminal therebetween.

(2) The connector of the above Paragraph (1) is further characterized in that the front holder has an abutment portion for abutting against the connection terminal; and the abutment portion can be deformed when the connection terminal abuts against the abutment portion.

(3) The connector of the above Paragraph (1) or Paragraph (2) is further characterized in that the front holder has a lance support portion, and when the front holder is retained with the front end portion of the terminal receiving chamber, the lance support portion abuts against the lance to prevent the elastic deformation of the lance.

(4) The connector of the above Paragraph (3) is further characterized in that the front holder includes a provisionally-retaining projection and a completely-retaining projection which are engageable with the front end portion of the terminal receiving chamber, and the front holder is completely retained with the front end portion of the terminal receiving chamber after the front holder is provisionally retained with the front end portion; and when the front holder is completely retained with the front end portion, the lance support portion abuts against the lance.

(5) The connector of the above Paragraph (1) is further characterized in that the connection terminal is allowed to be inserted into the terminal receiving chamber by elastically deforming the lance, and is engaged in the terminal receiving chamber by restoring the lance from a deformed condition, so that the connection terminal is prevented from being withdrawn in the opposite direction to the insertion direction.

In the connector having the construction of the above Paragraph (1), when the connector is completely fitted relative to the mating connector, the front holder abuts against the connection terminal, and cooperates with the lance to hold the connection terminal therebetween. Namely, at an initial stage of the fitting of the connector relative to the mating connector, the connection terminal can move, following a mating connection terminal, in accordance with the fitting movement of the two connectors thanks to the provision of a clearance (see the clearance formed between the projection 7 of the lance 4 and the retaining edge 8*a* of the opening 8 in FIG. 15) between the lance and the connection terminal. Therefore, as compared with the conventional connector in which the mating connection terminal is connected to the connection terminal completely prevented from moving within the terminal receiving chamber, a resistance to the insertion of the connection terminal is made smaller, and the connection terminal and the mating connection terminal are smoothly connected together. Therefore, the connector can be easily fitted to the mating connector, and besides the connection terminal can be prevented from being deformed. For canceling the fitting of the connector relative to the mating connector, first, the front holder is disengaged from the connection terminal, thus canceling the fixed condition of the connection terminal. Therefore, when disconnecting the mating connection terminal, the connection terminal can move, following the mating connection terminal, and the fitting of the connector relative to the mating connector can be easily canceled.

When the connector is completely fitted relative to the mating connector, the connection terminal is held between the front holder, pressed by the mating connector, and the lance, and is completely fixed in position within the terminal receiving chamber, and therefore is prevented from shaking. Therefore, even when vibration is applied to the connector, a relative slight sliding movement between contact portions of the connection terminal and mating connection terminal is prevented. Therefore, the decrease of the contact pressure due to wear of the contact portions is prevented, so that the reliability of electrical connection of the connection terminal can be maintained.

In the connector having the construction of the above Paragraph (2), the abutment portion of the front holder for abutting against the connection terminal can be deformed when the connection terminal abuts against the abutment portion, and therefore in the completely-fitted condition of the connector and mating connector, the connection terminal can be positively held between the front holder and the lance without excessively pressing the connection terminal.

In the connector having the construction of the above Paragraph (3), the elastic deformation of the lance is prevented by the lance support portion of the front holder retained with the front end portion of the terminal receiving chamber, and therefore the lance can more positively prevent the withdrawal of the connection terminal, and also in the completely-fitted condition of the connector and mating connector, the connection terminal can be more positively held between the front holder and the lance.

In the connector having the construction of the above Paragraph (4), the front holder can be retained with the front end portion of the terminal receiving chamber in a two-step manner, that is, in the provisionally retained condition and the completely-retained condition. In the provisionally-retained condition of the front holder, the lance can be elastically deformed, and in the completely-retained condition the lance support portion abuts against the lance to prevent the elastic deformation of the lance. Therefore, the front holder is held in the provisionally-retained condition, and in this condition the connection terminal can be inserted into the terminal receiving chamber while elastically deforming the lance. Namely, there is no need to remove the front holder from the front end portion of the terminal receiving chamber, and therefore the front holder is prevented from being lost, and besides the insertion of the connection terminal into the terminal receiving chamber can be easily effected.

In the connector of the present invention, the shaking of the connection terminal can be prevented without increasing a resistance to the insertion of the connection terminal, and the fitting connection of the connector to the mating connector, as well as the cancellation of this fitting connection, can be easily effected, and besides even when vibration is applied to the connector, the reliability of electrical connection of the connection terminal can be maintained.

The present invention has been briefly described above. Details of the invention will become manifest upon reading of the following Section "Best Mode for Carrying Out the Invention" with reference to the accompanying drawings.

DETAILED DESCRIPTION OF THE PREFERRED EMBODIMENTS

A preferred embodiment of a connector of the present invention will now be described in detail with reference to the drawings.

Figure 1:
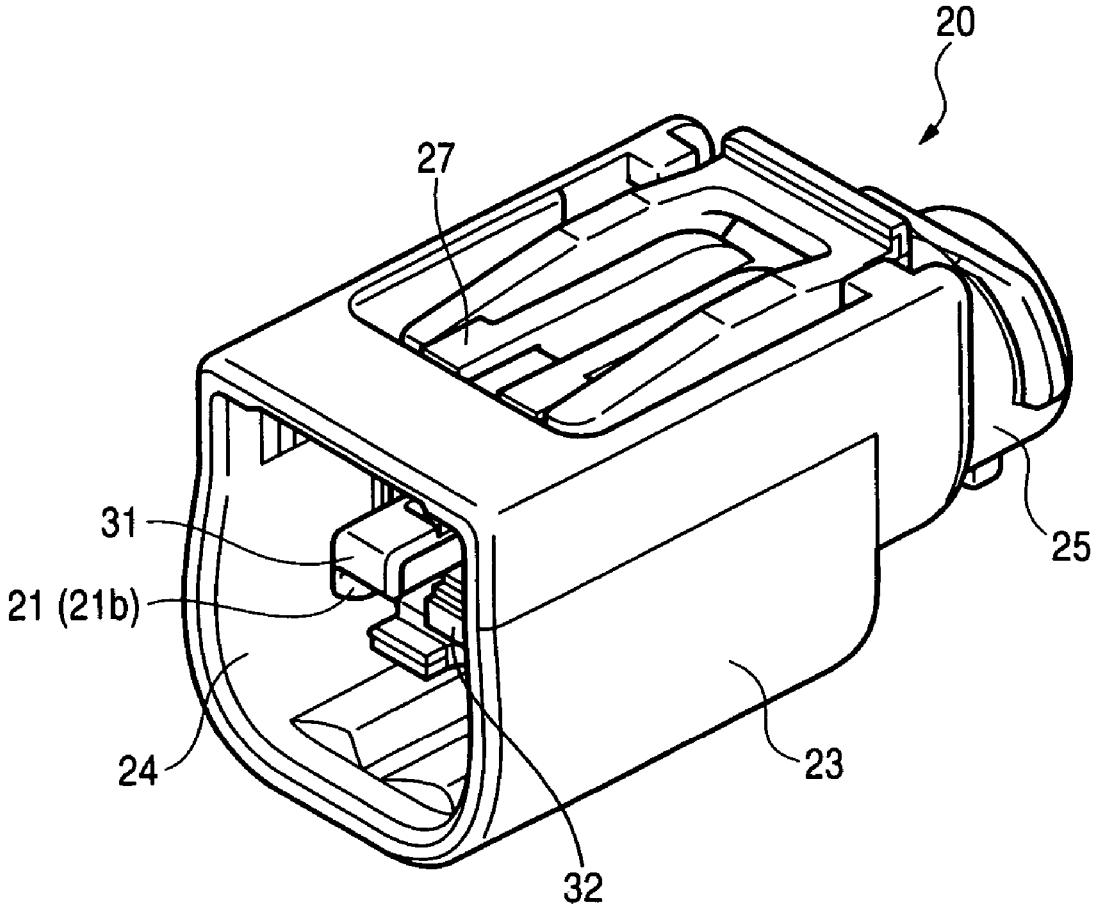
FIG. 1 is a perspective view of a connector housing of one preferred embodiment of a connector of the present invention.
Figure 2:
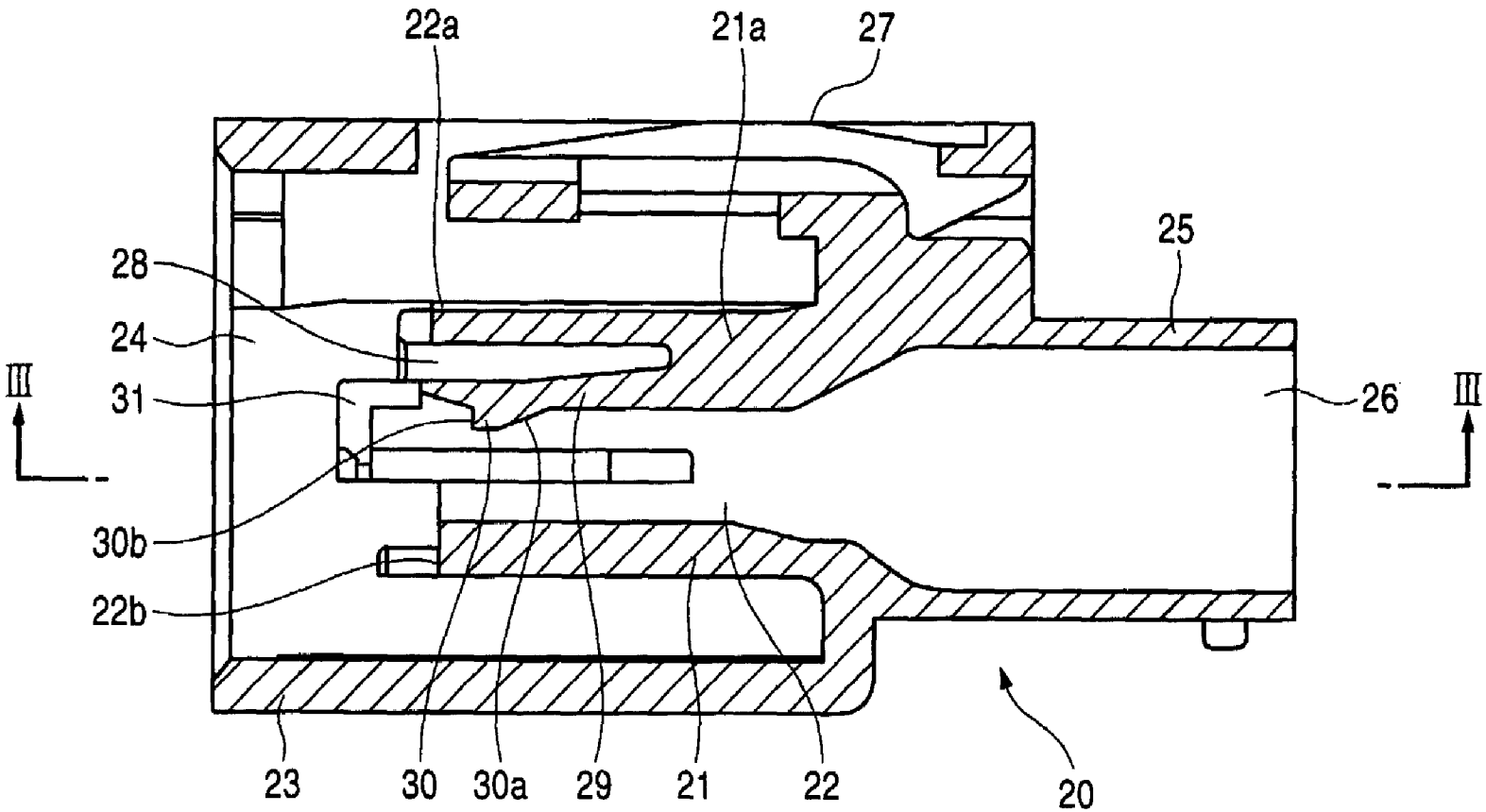
FIG. 2 is a vertical cross-sectional view of the connector housing of FIG. 1.
Figure 3:
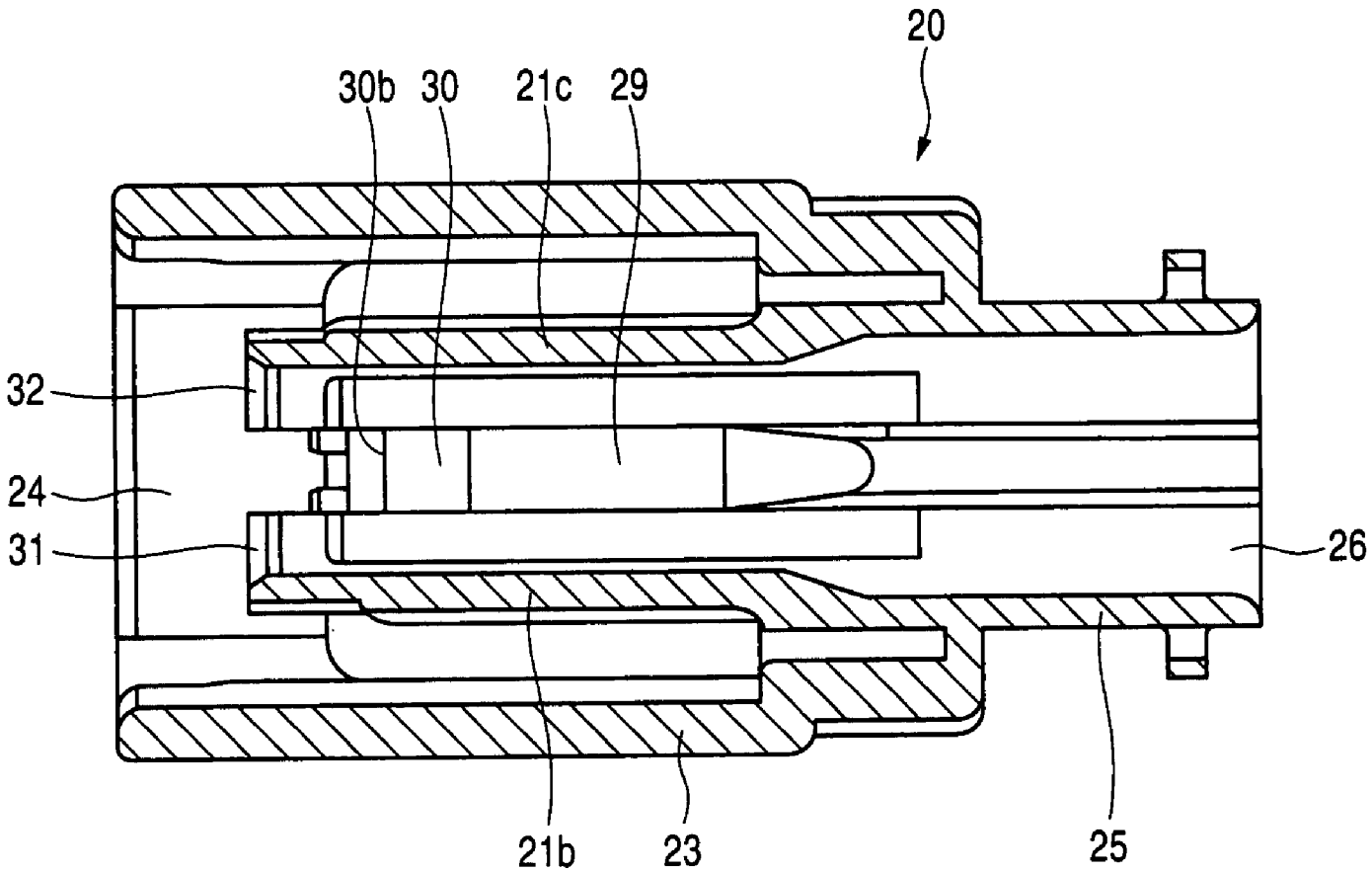
FIG. 3 is a cross-sectional view taken along the line III—III of FIG. 2.
Figure 4:
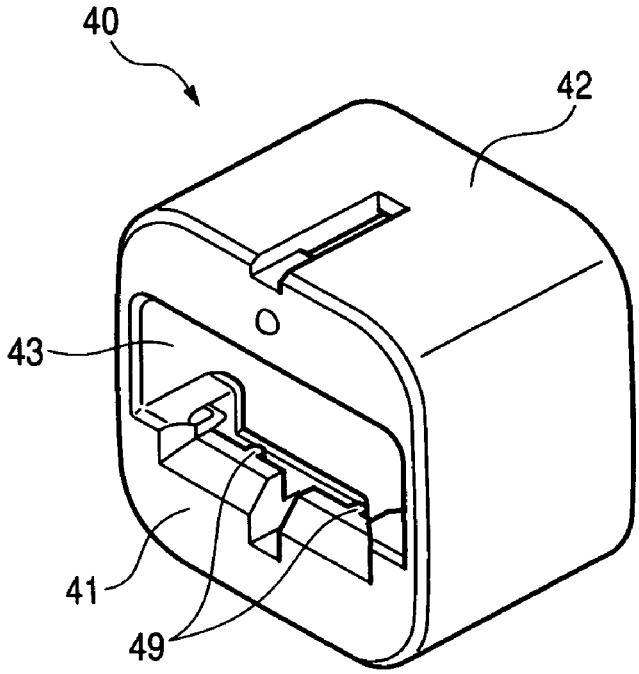
FIG. 4 is a perspective view of a front holder of the connector of this embodiment.
Figure 5:
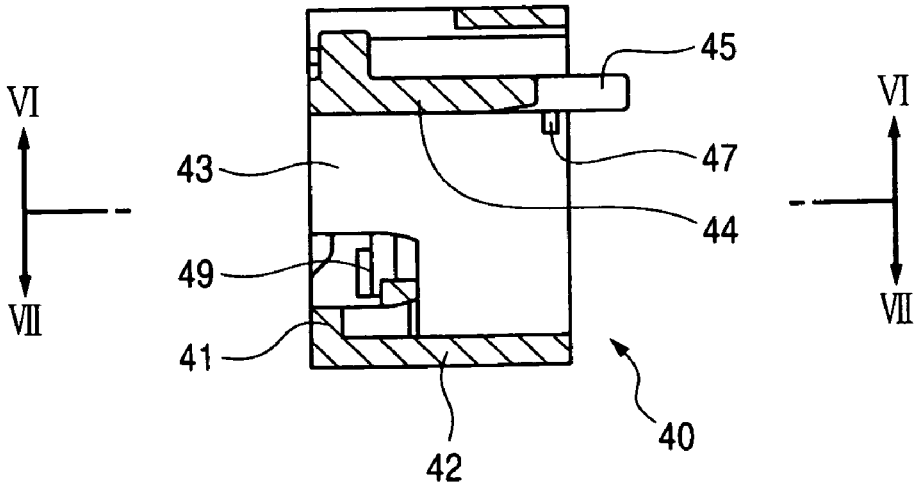
FIG. 5 is a vertical cross-sectional view of the front holder of FIG. 4.
Figure 6:
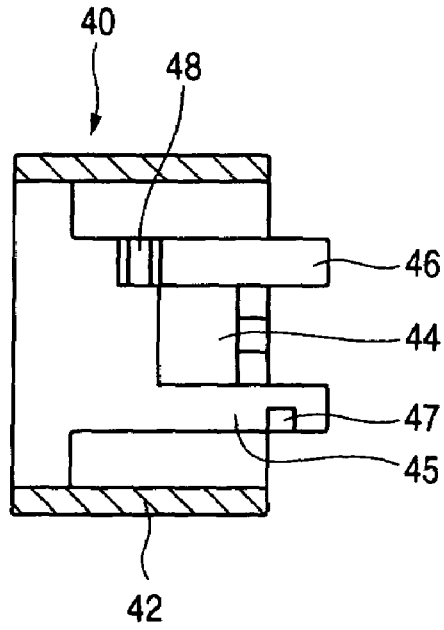
FIG. 6 is a cross-sectional view taken along the line VI—VI of FIG. 5.
Figure 7:
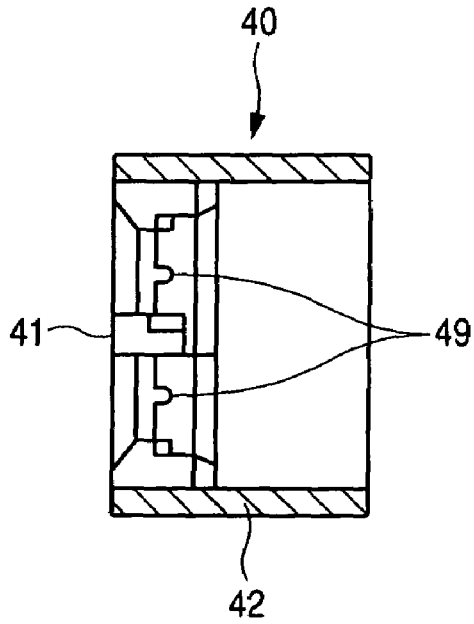
FIG. 7 is a cross-sectional view taken along the line VII—VII of FIG. 5.
Figure 8:
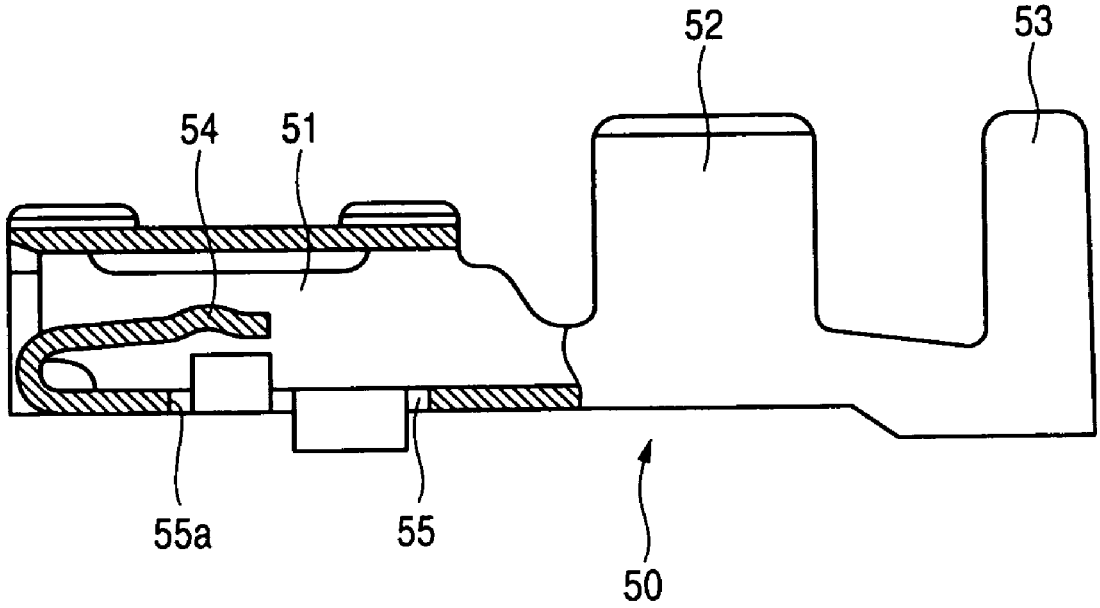
FIG. 8 is a partly broken side-elevational view of a connection terminal of the connector of this embodiment.

FIG. 1 is a perspective view of a connector housing of one preferred embodiment of the connector of the invention, FIG. 2 is a vertical cross-sectional view of the connector housing of FIG. 1, FIG. 3 is a cross-sectional view taken along the line III—III of FIG. 2, FIG. 4 is a perspective view of a front holder of the connector of this embodiment, FIG. 5 is a vertical cross-sectional view of the front holder of FIG. 4, FIG. 6 is a cross-sectional view taken along the line VI—VI of FIG. 5, FIG. 7 is a cross-sectional view taken along the line VII—VII of FIG. 5, and FIG. 8 is a partly broken side-elevational view of a connection terminal of the connector of this embodiment.

Figure 9:
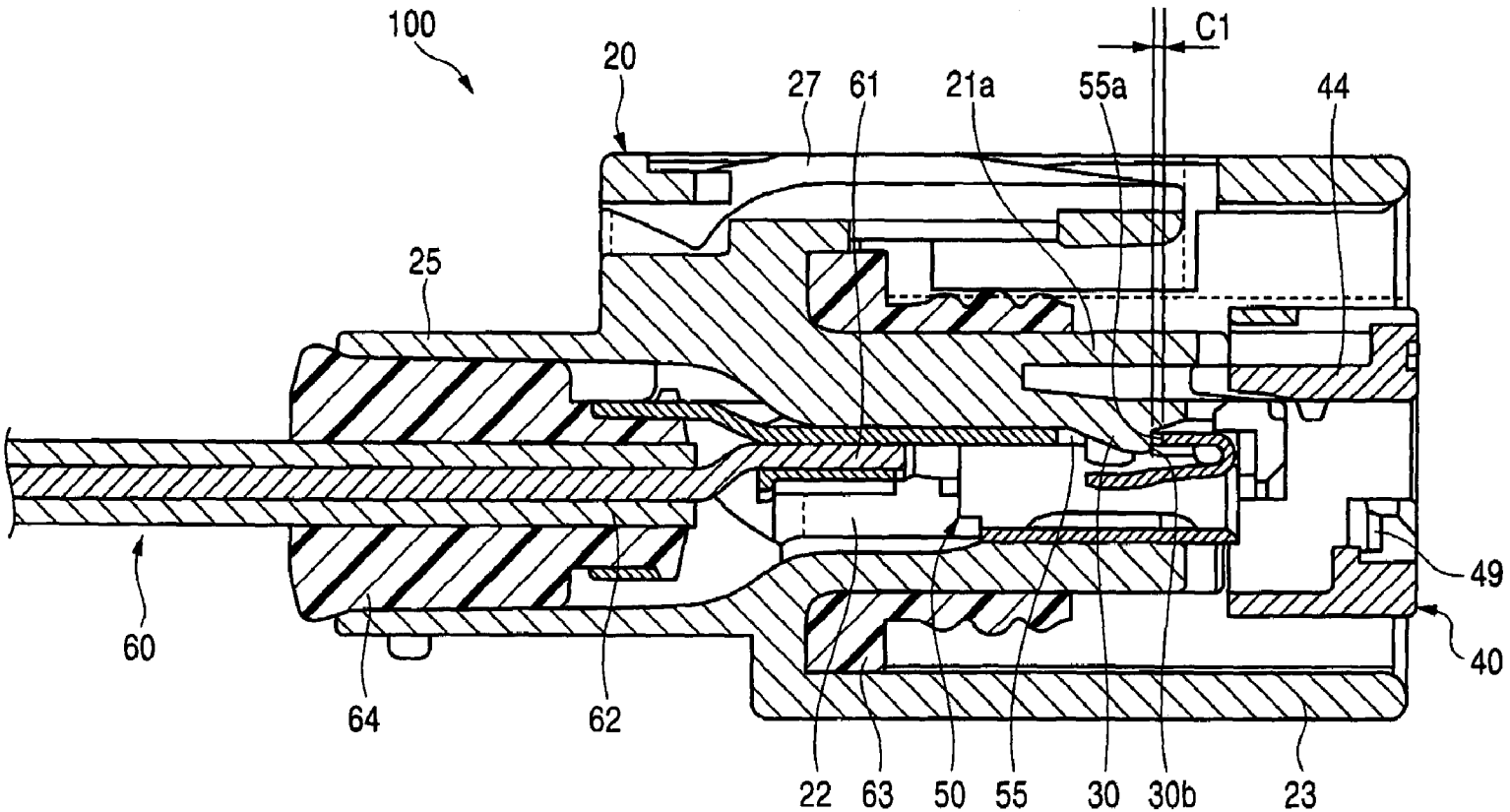
FIG. 9 is a vertical cross-sectional view of the connector, showing a condition in which the connection terminal is inserted in a terminal receiving chamber of the connector housing with which the front holder is provisionally retained.
Figure 10:
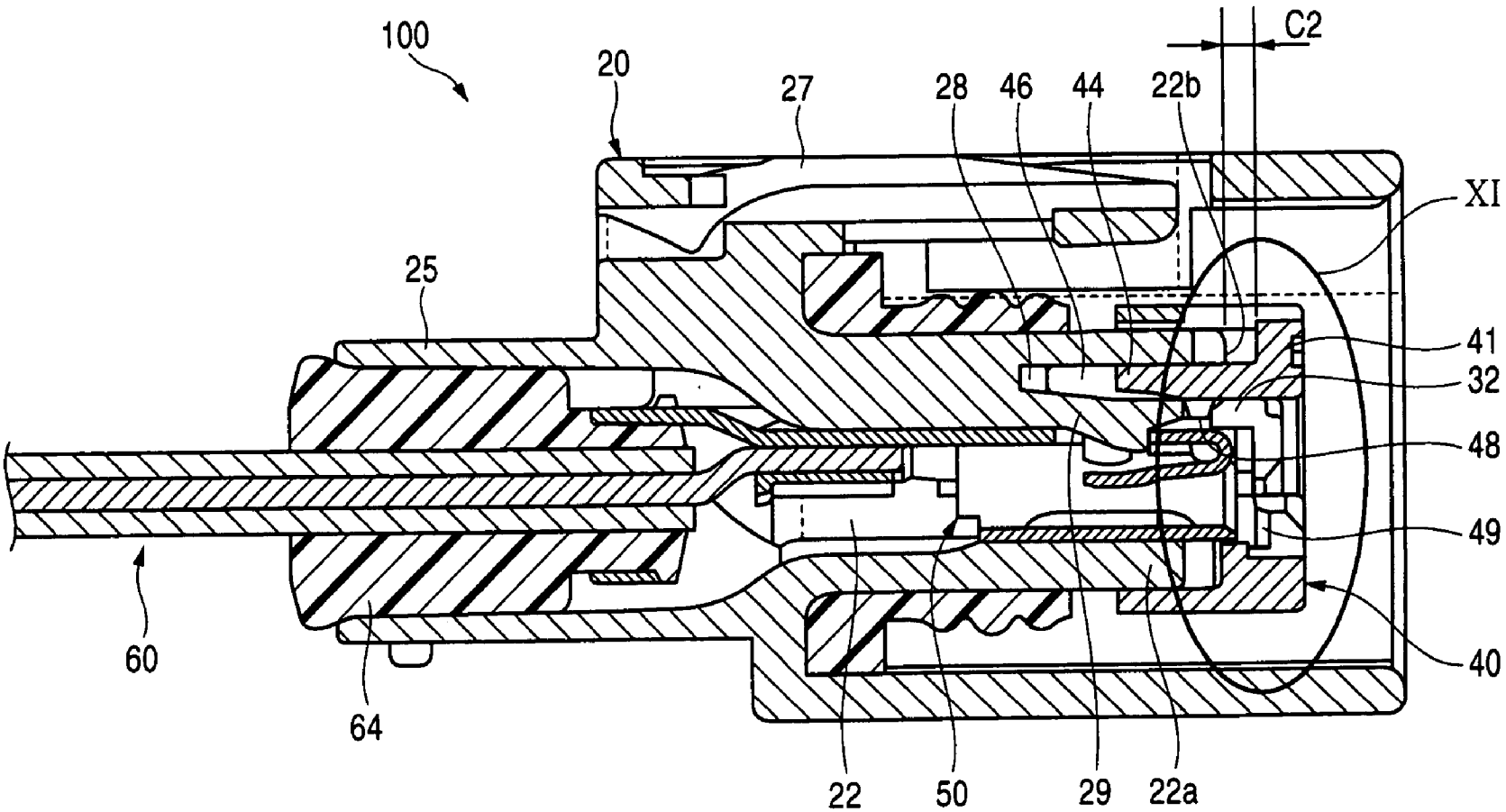
FIG. 10 is a vertical cross-sectional view of the connector, showing a condition in which the front holder is completely retained with the terminal receiving chamber of the connector housing.
Figure 11:
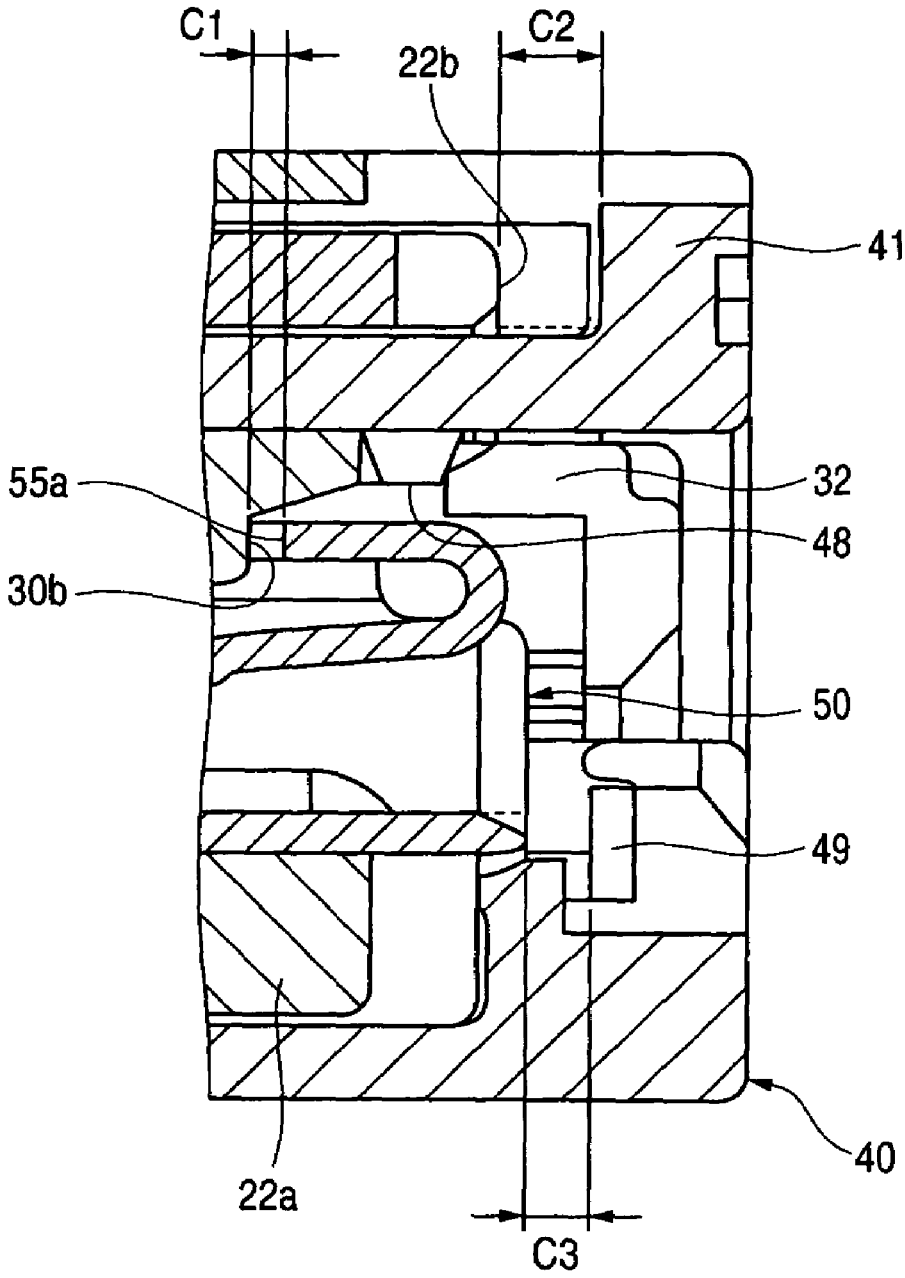
FIG. 11 is an enlarged view of a portion encircled by an ellipse XI of FIG. 10.
Figure 12:
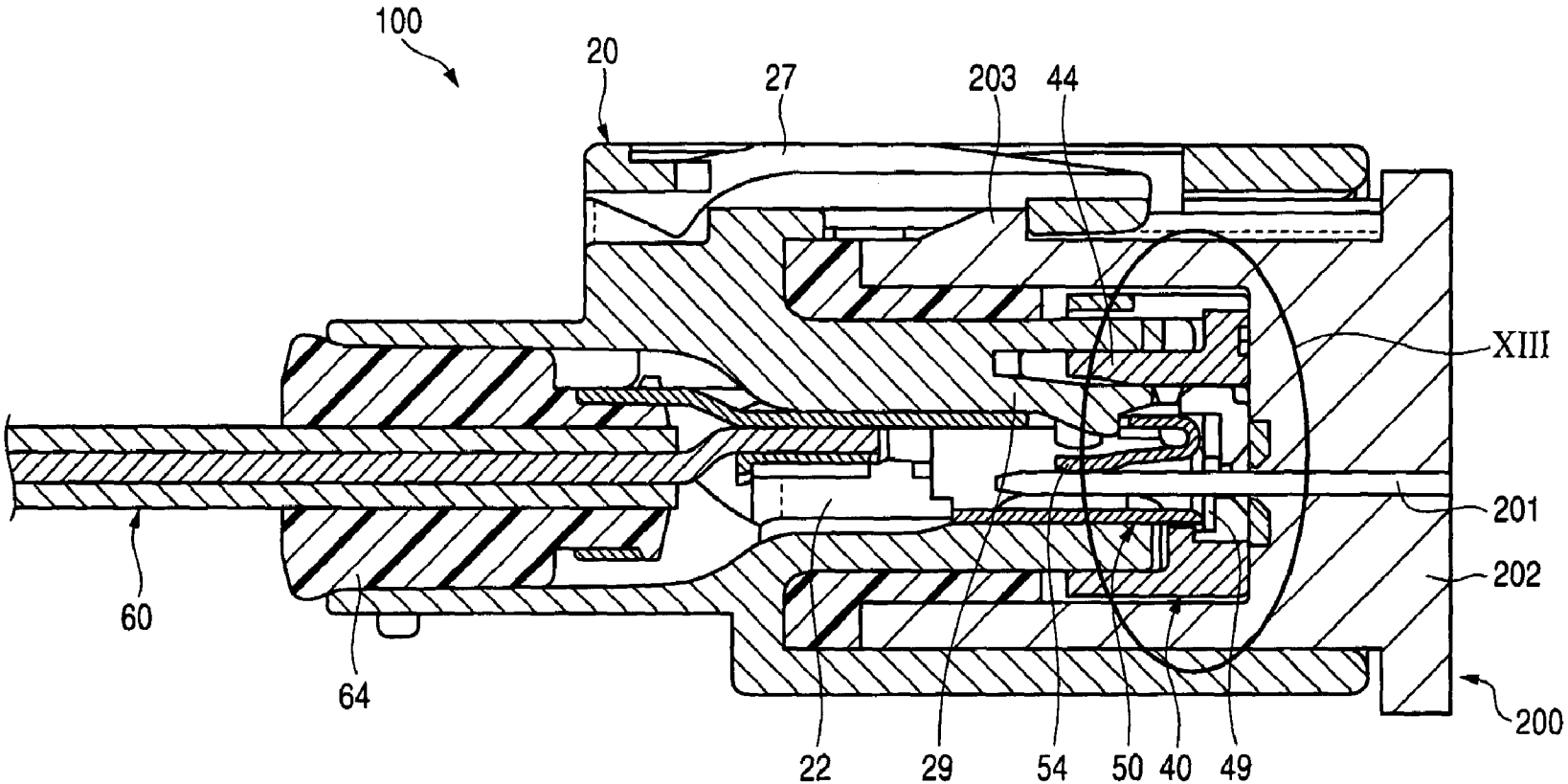
FIG. 12 is a vertical cross-sectional view showing the connector fitted on a mating connector.
Figure 13:
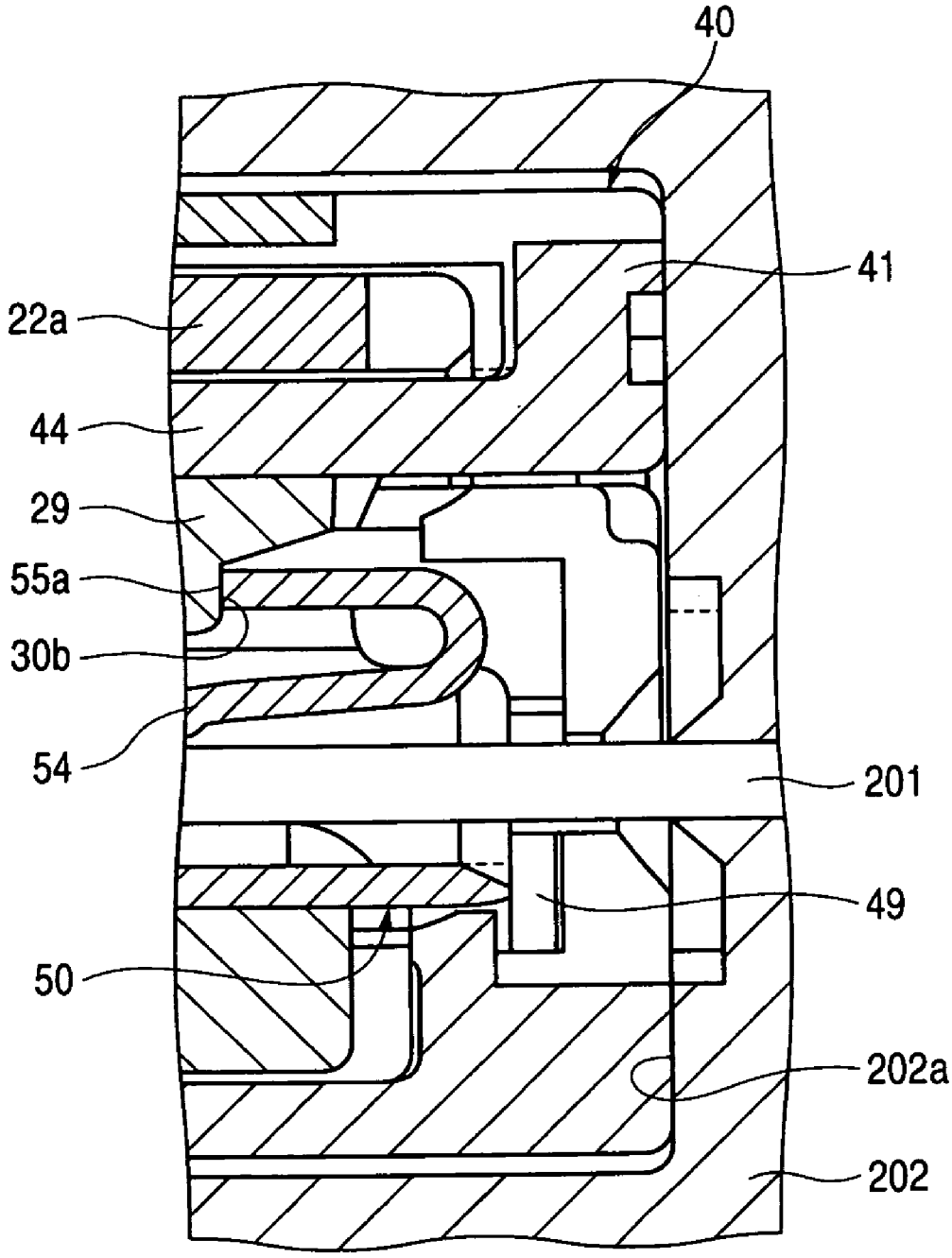
FIG. 13 is an enlarged view of a portion encircled by an ellipse XIII of FIG. 12.
Figure 14:
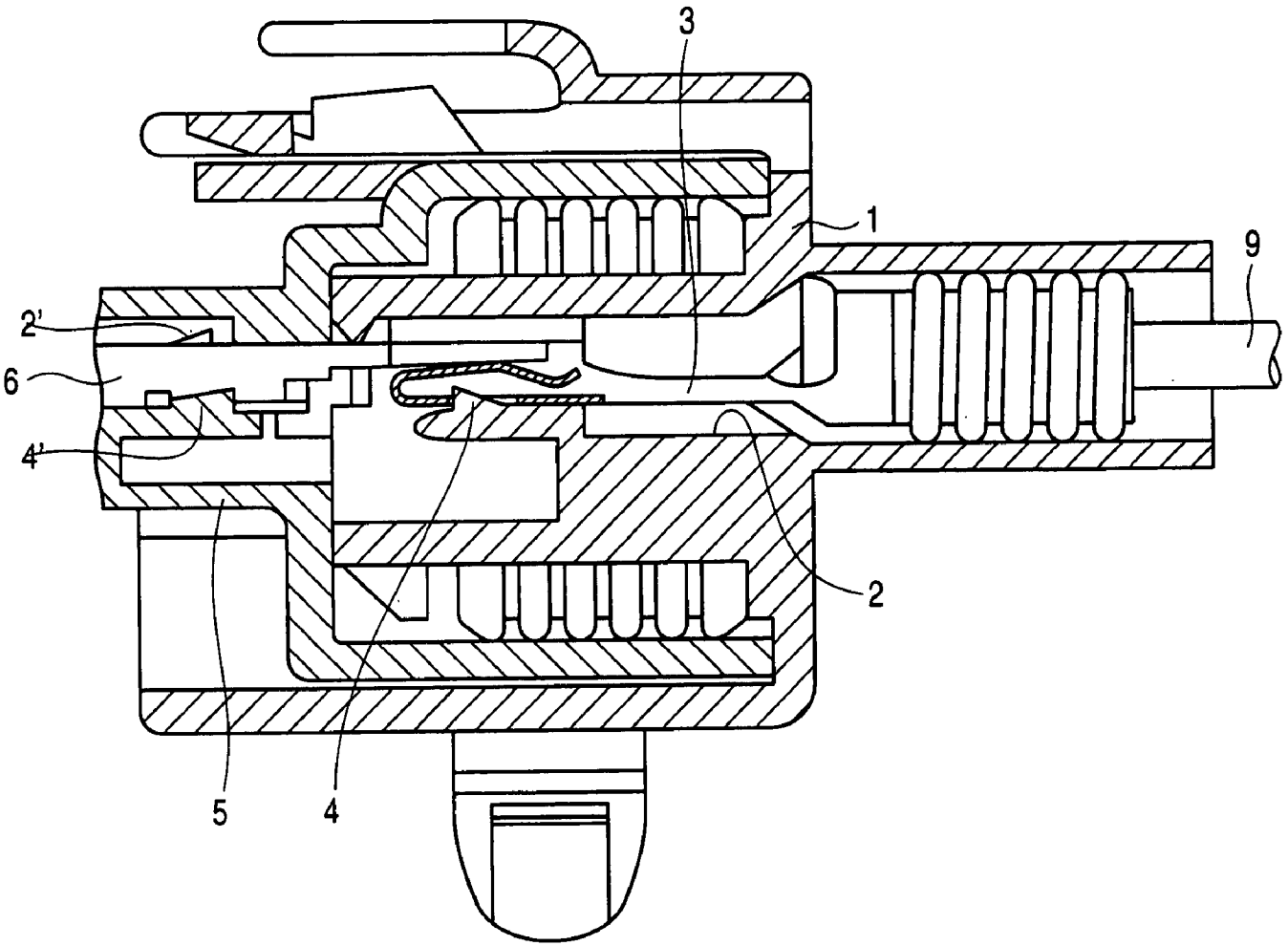
FIG. 14 is a vertical cross-sectional view of a conventional connector.
Figure 15:
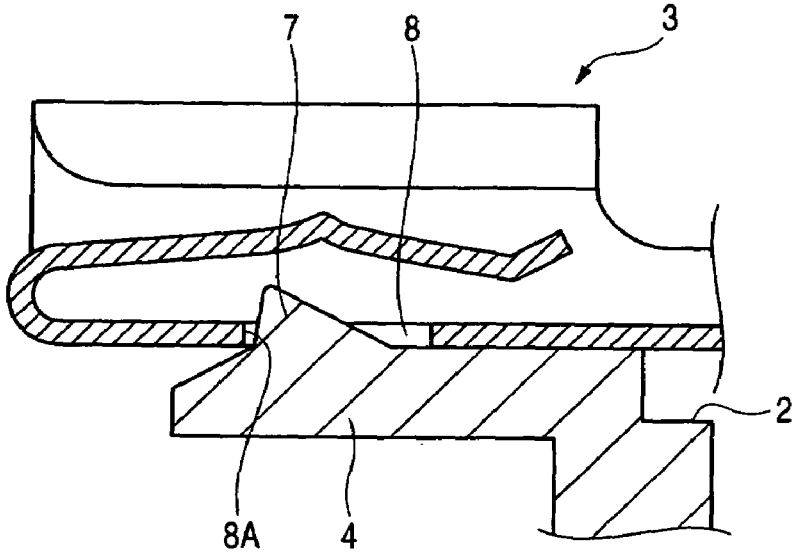
FIG. 15 is an enlarged view of an important portion of the connector of FIG. 14.
Figure 16:
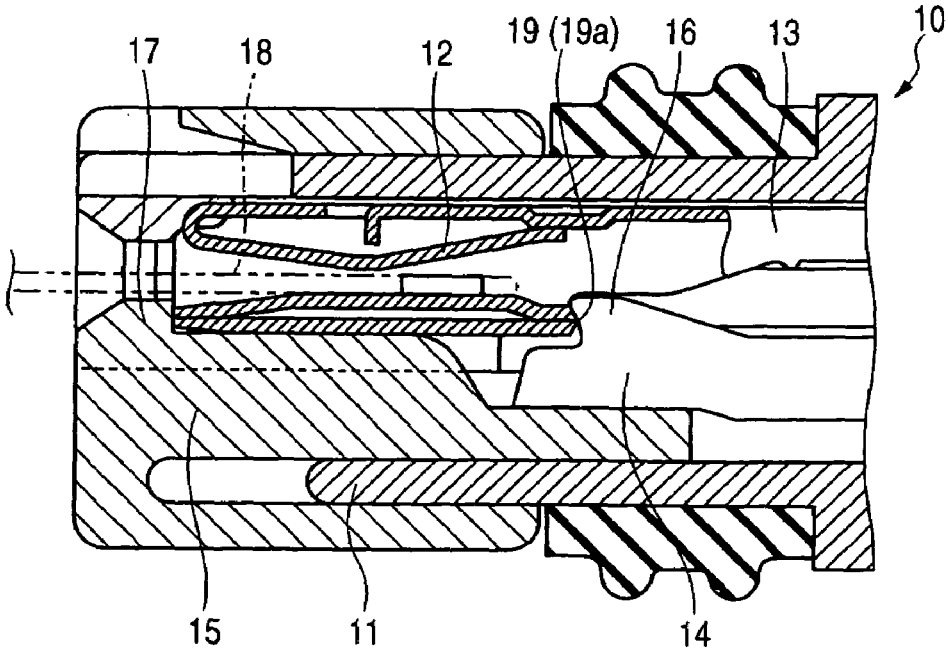
FIG. 16 is a vertical cross-sectional view of another conventional connector.

FIG. 9 is a vertical cross-sectional view of the connector, showing a condition in which the connection terminal is inserted in a terminal receiving chamber of the connector housing with which the front holder is provisionally retained, FIG. 10 is a vertical cross-sectional view of the connector, showing a condition in which the front holder is completely retained with the terminal receiving chamber of the connector housing, FIG. 11 is an enlarged view of a portion encircled by an ellipse XI of FIG. 10, FIG. 12 is a vertical cross-sectional view showing the connector fitted on a mating connector, and FIG. 13 is an enlarged view of a portion encircled by an ellipse XIII of FIG. 12.

The female connector 100 which is one preferred embodiment of the connector of the invention will be described below. The female connector 100 comprises the female terminal (connection terminal) 50, the female connector housing 20 having the terminal receiving chamber 22 (into which the female terminal 50 is inserted from a rear opening thereof) and a lance 29 for preventing the withdrawal of the female terminal 50 received in the terminal receiving chamber 22, and the front holder 40 attached to a front end portion 22*a* of the terminal receiving chamber 22.

As shown in FIGS. 1 to 3, the female connector housing 20 is made of a synthetic resin, and has the terminal receiving chamber 22 which is defined by an outer wall 21 of a generally rectangular tubular shape, the terminal receiving chamber 22 having open front and rear ends. The periphery of the terminal receiving chamber 22 is covered with a hood portion 23 of a generally rectangular tubular shape. A front end portion of the hood portion 23 projects forwardly beyond the front end portion 22*a* of the terminal receiving chamber 22, and defines an opening portion 24 into which the male connector 200 (see FIG. 12), serving as the mating connector, can be inserted. A wire insertion hole 26, defined by a hollow cylindrical wall 25, extends continuously from the rear end of the terminal receiving chamber 22.

A notch is formed through one side wall of the hood portion 23 in a direction of a thickness thereof, and an elastic retaining piece portion 27 for retaining the inserted male connector 200 is provided within this notch. In the following description, that side of the connector 100 where the elastic retaining piece portion 27 of the female connector housing 20 is provided will be referred to as "the upper side", while the opposite side will be referred to as "the lower side", and based on this upper-lower direction, the right side of the connector 100 when viewed from the front side thereof will be referred to as "right direction", while the left side thereof will be referred to as "left direction".

The cantilever-like lance 29 is formed on an upper wall 21*a* (which is part of the outer wall 21 defining the terminal receiving chamber 22), and projects into the terminal receiving chamber 22. This lance 29 extends forwardly such that a space (flexure space) 28 is formed between the upper wall 21*a* and the lance 29. The lance 29 can be elastically deformed in such a manner that its front end portion moves toward the upper wall 21*a*. A projection 30 is formed on the front end portion of the lance 29, and projects downwardly therefrom. This projection 30 has a rear slanting surface 30*a* slanting downwardly toward the front end of the lance 29. A front end surface of the projection 30 is disposed generally vertically, and serves as a retaining surface 30*b*.

Engagement convex portions 31 and 32 are formed respectively on left and right side walls 21*b* and 21*c* (which are part of the outer wall 21 defining the terminal receiving chamber 22), and project toward each other respectively from the left and right side walls 21*b* and 21*c*, these engagement convex portions 31 and 32 being disposed forwardly beyond the front end of the lance 29. A provisionally-retaining projection 47 and a completely-retaining projection 48 of the front holder 40 (described later) can be engaged with the engagement convex portions 31 and 32, respectively.

As shown in FIGS. 4 to 7, the front holder 40 is made of a synthetic resin, and includes a front wall 41, and an outer wall 42 which extends rearwardly from a peripheral edge of the front wall 41, and can be fitted on the front end portion 22*a* of the terminal receiving chamber 22 of the female connector housing 20.

A terminal passage hole 43 is formed through a central portion of the front wall 41. When the front holder 40 is retained with the front end portion 22*a* of the terminal receiving chamber 22, the terminal passage hole 43 is opposed to the front open end of the terminal receiving chamber 22, and a male terminal 201 (see FIG. 13) of the male connector 200, serving as a mating terminal, can pass through this terminal passage hole 43.

A plate-like lance support portion 44 extends rearwardly from a rear surface of the front wall 41, and projecting piece portions 45 and 46 are formed respectively at left and right sides of the lance support portion 44, and extend rearwardly. When the front holder 40 is completely retained with the front end portion 22*a* of the terminal receiving chamber 22, the lance support portion 44 is inserted in the flexure space 28. The provisionally-retaining projection 47 is formed on a lower surface of the projecting piece portion 45, and the completely-retaining projection 48 is formed on a lower surface of the projecting piece portion 46, and is disposed forwardly of the provisionally-retaining projection 47 formed on the projecting piece portion 45. A plurality of ribs 49, serving as abutment portions, are formed on and project rearwardly from the rear surface of the front wall 41.

As shown in FIG. 8, the female terminal 50 is formed by pressing an electrically-conductive metal sheet, and includes a connection portion 51 of a generally rectangular tubular shape formed at a front end portion thereof, and press-clamping portions 52 and 53 of a generally U-shaped cross-section formed at a rear end portion thereof. The press-clamping portions 52 and 53 are press-fastened respectively to a conductor 61 and a sheath 62 of a wire 60. The connection portion 51 has an electrical connection piece portion 54 provided therein, and this piece portion 54 extends from a front edge of the female terminal, and is bent back at this front edge. The connection portion 51 has an opening 55 formed through one side wall thereof, and the projection 30, formed on the lance 29 of the female connector housing 20, can be fitted in this opening 55.

Next, the assembling of the female connector 100 will be described. First, a packing 63, made of an elastic material such as silicone rubber, is mounted in the female connector housing 20, and is disposed between the outer surface of the terminal receiving chamber 22 and the inner surface of the hood portion 23 as shown in FIG. 9. Then, the front holder 40 is provisionally retained with the front end portion 22*a* of the terminal receiving chamber 22. At this time, the provisionally-retaining projection 47, formed on the projecting piece portion 45 of the front holder 40, slides over the engagement convex portion 31 of the female connector housing 20, and is brought into engagement with a rear surface of this engagement convex portion 31, thereby effecting the provisional retaining of the front holder 40.

At this time, the lance support portion 44 of the front holder 40 is not yet inserted in the flexure space 28 of the female connector housing 20, and therefore the lance 29 can be elastically deformed. In this condition, the female terminal 50, having the wire 60 fixed thereto by press-clamping, is inserted into the terminal receiving chamber 22 through the wire insertion hole 26. A packing 64 is provided between the outer peripheral surface of the wire 60 and the inner peripheral surface of the hollow cylindrical wall 25 defining the wire insertion hole 26.

When the female terminal 50 is inserted into the terminal receiving chamber 22, the front end of the female terminal 50 is brought into abutting engagement with the slanting surface 30*a* of the projection 30 of the lance 29, and the female terminal 50 is further inserted into the terminal receiving chamber 22 while elastically deforming the lance 29 in such a manner that the front end portion of the lance 29 is moved toward the upper wall 21*a* of the terminal receiving chamber 22. When the female terminal 50 reaches a predetermined position within the terminal receiving chamber 22, the lance 29 is restored from its elastically-deformed condition, so that the projection 30 of the lance 29 is fitted into the opening 55 in the female terminal 50.

At this time, a clearance C1 is formed between the retaining surface 30*b* of the projection 30 of the lance 29 and a front edge 55*a* of the opening 55 of the female terminal 50, and therefore the female terminal 50 can move forward and rearward within the terminal receiving chamber 22 in an amount corresponding to the clearance C1. The clearance C1 is set to such a value that when the lance 29 is elastically deformed to be pivotally moved about its rear end portion, the projection 30, formed on the front end portion thereof, will not interfere with the front edge 55*a* of the opening 55 of the female terminal 50.

Then, the front holder 40 is completely retained with the front end portion 22*a* of the terminal receiving chamber 22 as shown in FIGS. 10 and 11. At this time, the front holder 40, provisionally retained with the front end portion 22*a* of the terminal receiving chamber 22, is pushed rearwardly, and by doing so, the completely-retaining projection 48 of the projecting piece portion 46 (which is disposed forwardly of the provisionally-retaining projection 47 of the projecting piece portion 45) slides over the engagement convex portion 32, and is brought into engagement with a rear surface of this engagement convex portion 32, thereby effecting the complete retaining of the front holder 40.

At this time, the lance support portion 44 of the front holder 40 is inserted in the flexure space 28 within the terminal receiving chamber 22 to prevent the elastic deformation of the lance 29. In this completely-retained condition of the front holder 40, a clearance C2 is formed between the rear surface of the front wall 41 of the front holder 40 and a front end surface 22*b* of the terminal receiving chamber 22. Therefore, the front holder 40 can move rearward in an amount corresponding to the clearance C2. The clearance C2 is larger than the clearance C1. In the completely-retained condition of the front holder 40, the front edge of the female terminal 50 is held in contact with the ribs 49 formed on the rear surface of the front wall 41 of the front holder 40, or a clearance C3 (which is smaller than the difference between the clearances C2 and C1) is formed between this front edge and each rib 49.

Next, the fitting of the female connector 100 relative to the male connector (mating connector) 200 will be described. As shown in FIGS. 12 and 13, the male connector 200 comprises the male terminal (mating connection terminal) 201, and a male connector housing 202 holding the male terminal 201. The male connector housing 202 is inserted into the hood portion 23 through the opening portion 24, thereby fitting the male connector 200 into the female connector 100. In accordance with the fitting movement of the male connector 200, the male terminal 201 of the male connector 200 is inserted into the terminal receiving chamber 22 through the terminal passage hole 43 from the front end of the female connector, and is brought into contact with the electrical connection piece portion 54 of the female terminal 50. At this time, the female terminal 50, while following the male terminal 201 to be moved rearward in an amount corresponding to the clearance C1, is electrically connected to the male terminal 201.

When the male connector 200 is further moved in the fitting direction, a bottom portion 202*a* of the male connector housing 202 is brought into abutting engagement with the front wall 41 of the front holder 40, and presses the front holder 40 rearward. The thus pressed front holder 40 is pushed and moved rearward, so that the ribs 49 of the front holder 40 abut against the front edge of the female terminal 50. The rearward movement of the female terminal 50 is prevented by the retaining surface 30*b* of the lance 29 abutting against the front edge 55*a* of the opening 50, and therefore the female terminal 50 is held between the front holder 40 and the lance 29. The ribs 49 of the front holder 40 are deformed by the front edge of the female terminal 50 abutting against the ribs 49, and therefore the front edge of the female terminal 50 slightly bites into the ribs 49.

At this time, the elastic retaining piece portion 27 of the female connector housing 20 is engaged with a retaining projection 203 formed on an upper surface of the male connector housing 202, so that the female connector 100 and the male connector 200 are fixed to each other in a completely-fitted condition.

When the female connector 100 of this embodiment is completely fitted on the male connector (mating connector) 200, the front holder 40 abuts against the female terminal 50, and cooperates with the lance 29 to hold the female terminal 50 therebetween. Namely, at the initial stage of the fitting of the female connector 100 relative to the male connector 200, the female terminal 50 can move, following the male terminal 201, in accordance with the fitting movement of the female and male connectors 100 and 200 thanks to the provision of the clearance C1 between the lance 29 and the female terminal 50. Therefore, as compared with the conventional connector in which the mating connection terminal is connected to the connection terminal completely prevented from moving within the terminal receiving chamber, a resistance to the insertion of the male terminal into the female terminal 50 is made smaller, and the female and male terminals 50 and 201 are smoothly connected together. Therefore, the female connector can be easily fitted on the male connector 200, and besides the female terminal 50 can be prevented from being deformed. For canceling the fitting of the female connector relative to the male connector 200, first, the front holder 40 is disengaged from the female terminal 50, thus canceling the fixed condition of the female terminal 50. Therefore, when disconnecting the male terminal 201, the female terminal 50 can move, following the male terminal 201, and the fitting of the female connector relative to the male connector 200 can be easily canceled.

When the female connector is completely fitted on the male connector 200, the female terminal 50 is held between the front holder 40, pressed by the male connector 200, and the lance 29, and is completely fixed in position within the terminal receiving chamber 22, and therefore is prevented from shaking. Therefore, even when vibration is applied to the female connector 100, a relative slight sliding movement between contact portions of the female and male terminals 50 and 201 is prevented. Therefore, the decrease of the contact pressure due to wear of the contact portions is prevented, so that the reliability of electrical connection of the female terminal 50 can be maintained.

The ribs 49, serving as the abutment portions for abutting against the female terminal 50, can be deformed when the female terminal 50 abuts against the ribs 49, and therefore in the completely-fitted condition of the female connector and male connector 200, the female terminal 50 can be positively held between the front holder 40 and the lance 29 without excessively pressing the female terminal 50.

The elastic deformation of the lance 29 is prevented by the lance support portion 44 of the front holder 40 retained with the front end portion 22*a* of the terminal receiving chamber 22, and therefore the lance 29 can more positively prevent the withdrawal of the female terminal 50, and also in the completely-fitted condition of the female connector and male connector 200, the female terminal 50 can be more positively held between the front holder 40 and the lance 29.

The front holder 40 can be retained with the front end portion 22*a* of the terminal receiving chamber 22 in a two-step manner, that is, in the provisionally retained condition and the completely-retained condition. In the provisionally-retained condition of the front holder 40, the lance 29 can be elastically deformed, and in the completely-retained condition the lance support portion 44 abuts against the lance 29 to prevent the elastic deformation of the lance 29. Therefore, the front holder 40 is held in the provisionally-retained condition, and in this condition the female terminal 50 can be inserted into the terminal receiving chamber 22 while elastically deforming the lance 29. Namely, there is no need to remove the front holder 40 from the front end portion 22*a* of the terminal receiving chamber 22, and therefore the front holder 40 is prevented from being lost, and besides the insertion of the female terminal 50 into the terminal receiving chamber 22 can be easily effected.

The present invention is not limited to the above embodiment, and suitable modifications, improvements and so on can be made. The material, shape, dimensions, numerical value, form, number, disposition, etc., of each of the constituent elements of the above embodiment are arbitrary, and are not limited in so far as the invention can be achieved.

What is claimed is:

1. A connector comprising:

a connection terminal;

a connector housing having a terminal receiving chamber in which said connection terminal is inserted and a lance that is elastically deformable to engage said connection terminal in said terminal receiving chamber; and a front holder supported on a front end portion of said terminal receiving chamber so as to be movable along said inserting direction;

wherein said front holder is pressed by a mating connector to be moved in the opposite direction in accordance with a fitting movement of said connector relative to said mating connector; and when said connector is completely fitted relative to said mating connector, said front holder abuts against said connection terminal, and cooperates with said lance to hold said connection terminal therebetween, wherein said front holder has an abutment portion for abutting against said connection terminal; and said abutment portion is deformable when said connection terminal abuts against said abutment portion.

2. A connector according to claim 1, wherein said connection terminal is allowed to be inserted into said terminal receiving chamber by elastically deforming said lance, and is engaged in said terminal receiving chamber by restoring said lance from a deformed condition, so that said connection terminal is prevented from being withdrawn in the opposite direction to the insertion direction.

3. A connector according to claim 1, wherein said front holder has a lance support portion, and when said front holder is retained with the front end portion of said terminal receiving chamber, said lance support portion abuts against said lance to prevent the elastic deformation of said lance.

4. A connector according to claim 3, wherein said front holder includes a provisionally-retaining projection and a completely-retaining projection which are engageable with the front end portion of said terminal receiving chamber, and said front holder is completely retained with the front end portion of said terminal receiving chamber after said front holder is provisionally retained with said front end portion; and when said front holder is completely retained with the front end portion, said lance support portion abuts against said lance.

* * * * *